US007207502B2

(12) United States Patent
Wang et al.

(10) Patent No.: US 7,207,502 B2
(45) Date of Patent: Apr. 24, 2007

(54) VELOCITY PROFILE MODIFYING DEVICE FOR NOZZLES

(75) Inventors: Bang-Ji Wang, Taipei (TW); Chang-Chien Li, Hsin Chuan (TW); Chun-Ming Shen, Pan Chiao (TW)

(73) Assignee: Benq Corporation, Taoyuan (TW)

( * ) Notice: Subject to any disclaimer, the term of this patent is extended or adjusted under 35 U.S.C. 154(b) by 78 days.

(21) Appl. No.: 10/983,388

(22) Filed: Nov. 8, 2004

(65) Prior Publication Data

US 2005/0103884 A1 May 19, 2005

(30) Foreign Application Priority Data

Nov. 14, 2003 (TW) ..... 92131982 A

(51) Int. Cl.

| | |
|---|---|
| ***B05B 1/30*** | (2006.01) |
| ***B05B 1/14*** | (2006.01) |
| ***B05B 1/04*** | (2006.01) |
| ***A62C 31/02*** | (2006.01) |

(52) U.S. Cl. ..... 239/569; 239/589; 239/590.5; 239/593; 239/594

(58) Field of Classification Search ..... 239/569, 239/589, 590.5, 593, 594, 597, 599
See application file for complete search history.

(56) References Cited

U.S. PATENT DOCUMENTS

| | | | | |
|---|---|---|---|---|
| 3,075,396 A | | 1/1963 | Smith | |
| 3,419,220 A | * | 12/1968 | Goodwin et al. | 239/591 |
| 4,813,611 A | * | 3/1989 | Fontana | 239/589 |
| 5,616,067 A | * | 4/1997 | Goenka | 451/39 |
| 6,065,683 A | * | 5/2000 | Akin et al. | 239/5 |
| 6,132,049 A | | 10/2000 | Yamaguchi et al. | |
| 6,360,973 B1 | * | 3/2002 | Stilli | 239/590 |

FOREIGN PATENT DOCUMENTS

| | | |
|---|---|---|
| DE | 33 43 296 | 6/1985 |
| DE | 100 66 001 | 1/2002 |
| GB | 1107202 | 3/1968 |
| JP | 51-33348 | 3/1976 |
| JP | 52-117139 | 10/1977 |
| JP | 57-130714 | 8/1982 |
| JP | 59-36295 | 3/1984 |
| JP | 61-213541 | 9/1986 |
| JP | 2-237098 | 9/1990 |
| JP | 6-204747 | 7/1994 |
| JP | 6-59738 | 8/1994 |
| JP | 6-338212 | 12/1994 |
| JP | 10-115873 | 5/1998 |
| TW | 91205367 | 4/1991 |
| WO | 99/66776 | 12/1999 |

OTHER PUBLICATIONS

Patent Abstracts of Japan of 10-115873 dated May 6, 1998.

(Continued)

*Primary Examiner*—Davis Hwu
(74) *Attorney, Agent, or Firm*—Ladas & Parry

(57) ABSTRACT

A velocity-profile modifying device is located between a heat component and an air pouring apparatus. The air pouring apparatus pours the air into the heat component via an air moving track. The velocity-profile modifying device is set at the air moving track and is used for modifying a first velocity-profile of airflow by the air pouring apparatus to a second velocity-profile and further for making the air distribute evenly toward the heat component. By providing the velocity profile modifying device, a better distribution of the airflow toward the heat component and a stable temperature status of the heat component can be achieved.

12 Claims, 5 Drawing Sheets

OTHER PUBLICATIONS

Patent Abstract of Japan of 6-338212 dated Dec. 6, 1994.
Patent Abstract of Japan of 2-237098 dated Sep. 19, 1990.
Patent Abstracts of Japan of 57-130714 dated Aug. 13, 1982.
Patent Abstracts of Japan of 61-213541 dated Sep. 22, 1986.
Patent Abstracts of Japan of 52-117139 dated Oct. 1, 1977.
Patent Abstracts of Japan of 6-204747 dated Jul. 22, 1994.

* cited by examiner

VELOCITY PROFILE MODIFYING DEVICE FOR NOZZLES

BACKGROUND OF THE INVENTION

1. Field of the Invention

This present invention relates to a velocity-profile modifying device for nozzles.

2. Description of the Prior Art

Currently, a majority of electronic apparatuses comprises a major component which can produce lots of heat while in operations (so-called a heat component for short in the following). The existence of the heat component would make the electronic apparatus unstable and may damage neighboring components in the electronic apparatus if the heat produced by the heat component cannot be driven out properly. Among all apparatuses having various heat components, the heat-and-damage problem is particularly serious in a projector having a lighting component. The lighting component of the projector generally generates a great amount of light and heat during operations. If the heat in the projector can't be driven away, the lighting component or the neighboring components would be eventually damaged to further fail the projector.

Referring to FIG. 1, a schematic diagram of a typical lighting component 10 and a conventional cooling system 20 is shown. A shell 102 of the conventional lighting component 10 includes an air-entering opening 104 and an air-existing opening 106. The conventional cooling system 20 comprises a nozzle 202 and an electric fan 204. The nozzle 202 is connected with the air-entering opening 104. The electric fan 204 forces air to flow into the lighting component 10 via the nozzle 202. In this example, air drag and flow rate between the air-entering opening 104 and the air-existing opening 106 are two major factors in design to determine the power requirement in the electronic fan. Yet, less consideration in design has been put upon the cooling-the air density and pressure profile variation around the lighting component 10. Definitely, ignorance about the influence of the latter two factors upon the fan operation will make control of the fan way out of an optimal state.

In the example shown in FIG. 1, the nozzle 202 is used to compress the air before the air is poured into the lighting component 10. Because the velocity field of the air leaving the nozzle 202 is not uniform and has the maximum velocity in the central part of the airflow (as shown in FIG. 1), so theoretically in design the hottest portion of the lighting component 10 is always arranged to meet the central part of the airflow and thereby a best cooling effect in the lighting component 10 can be achieved. Nevertheless, while in the manufacture process, the actual hottest portion is usually shifted, and also the position or the angle of the nozzle 202 is never accurately set. As a consequence, the airflow portion with the maximum velocity doesn't aim right at the hottest portion inside the lighting component 10, and so it is expected that the performance of the cooling system would upon the lighting component 10 will degrade to a substantial extent.

Therefore, any effort to resolve the above problems and so to optimize the operation of the cooling system is definitely welcome to the skill in the art.

SUMMARY OF THE INVENTION

Accordingly, the object of this present invention is to provide a velocity-profile modifying device for directly modifying the velocity-profile pouring from the nozzle. The velocity-profile modifying device can have the air uniformly distributed and thus provide better cooling to the lighting apparatus or the lighting component.

Another object of the present invention is to provide a cooling system for appropriately responding the temperature of the lighting component by adjusting the flow rate of the electronic fan correspondingly.

Another object of the present invention is to provide a convenient design of a nozzle which can modify the velocity-profile of air so as to make the air evenly distributed toward the surface of the heat component.

The present invention provides a cooling system for controlling a temperature of a heat component. The heat component comprises an air-entering opening and an air-exiting opening to let the air enter and exit, respectively. The cooling system comprises an air pouring apparatus, a nozzle, a velocity-profile modifying device and a temperature sensing apparatus.

The air pouring apparatus is used for pouring the air into the heat component. The nozzle is used for connecting the air pouring apparatus with the air-entering opening to have the air pouring into the heat component directly. The velocity-profile modifying device is set at an air-moving track for modifying a first velocity-profile of air from the air pouring apparatus into a second velocity-profile, and then makes the air distribute evenly toward the heat component.

The temperature sensing apparatus is connected to the heat component and the air pouring apparatus for actively measuring the temperature of the heat component and controlling the airflow rate of the air pouring apparatus.

By including the velocity-profile modifying device into the cooling system in accordance with the present invention, uniform distribution of the airflow toward the surface of the heat component can then be obtained. Besides, the present invention includes an active temperature sensing apparatus, which can effectively adjust the flow rate of the air pouring apparatus by considering the temperature of the lighting component, so as to increase the cooling effect, to lower air brag, and thus to lower the noise from operating the nozzle.

Various advantages and spirits of the invention may be understood by the following recitations together with the appended drawings.

BRIEF DESCRIPTION OF THE APPENDED DRAWINGS

Figure 3C:
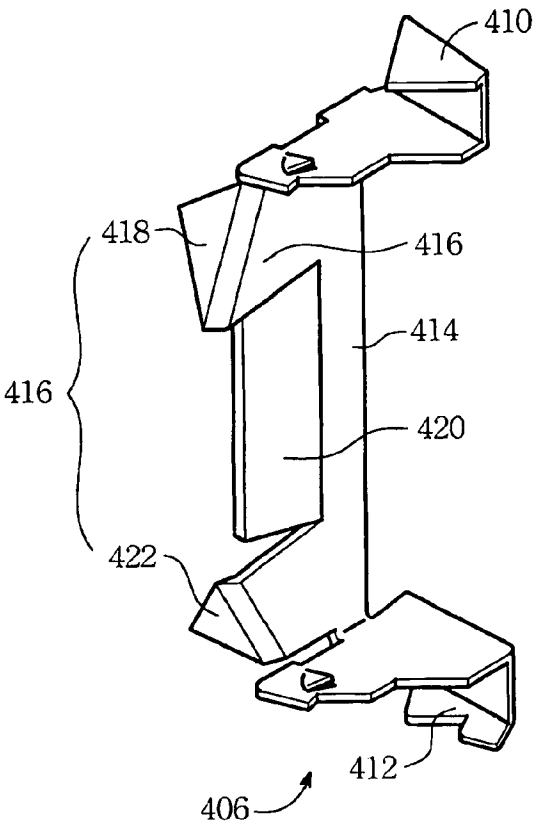
Figure 3B:
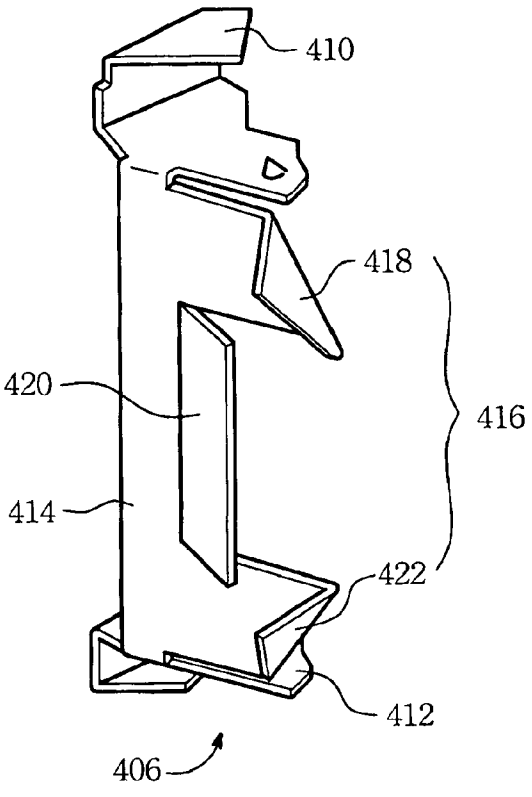
Figure 3A:
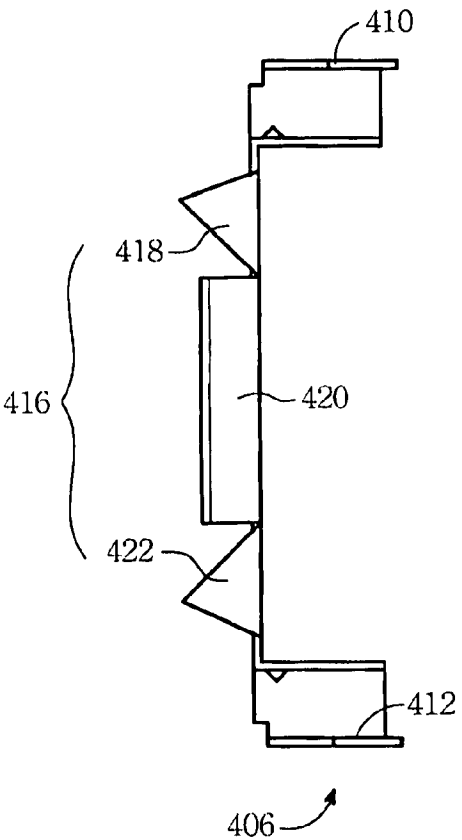

FIG. 3*a* is a front view of a preferred vane-type velocity-profile modifying device.

FIG. 3*b* is a left-front view of FIG. 3*a*.

FIG. 3*c* is a right-front view of FIG. 3*a*.

Figure 4B:
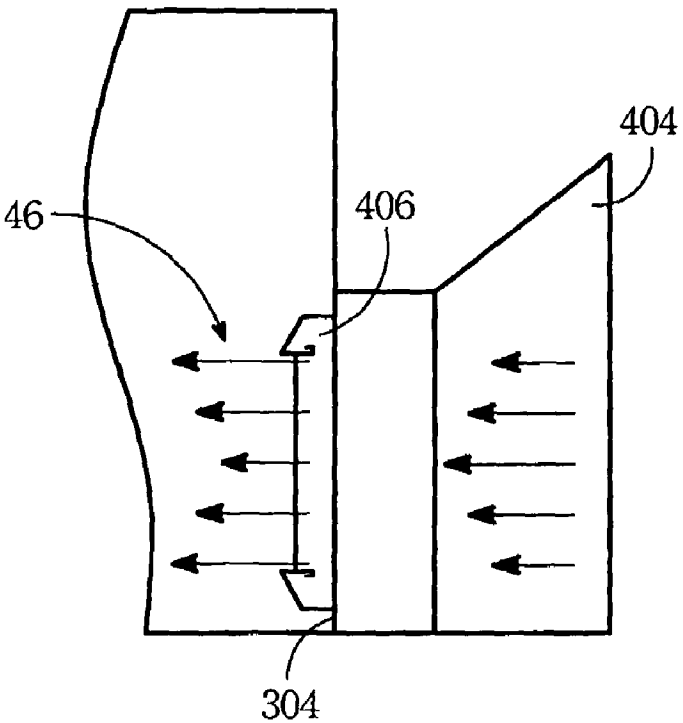
Figure 4A:
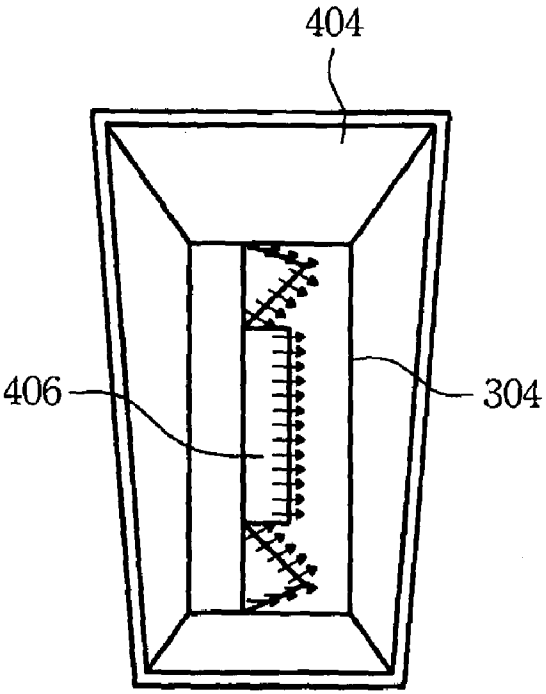

FIG. 4*a* is a front view of connecting the velocity-profile modifying device, the nozzle, and the air-entering opening.

FIG. 4*b* is the side view of FIG. 4*a*.

Figure 4C:
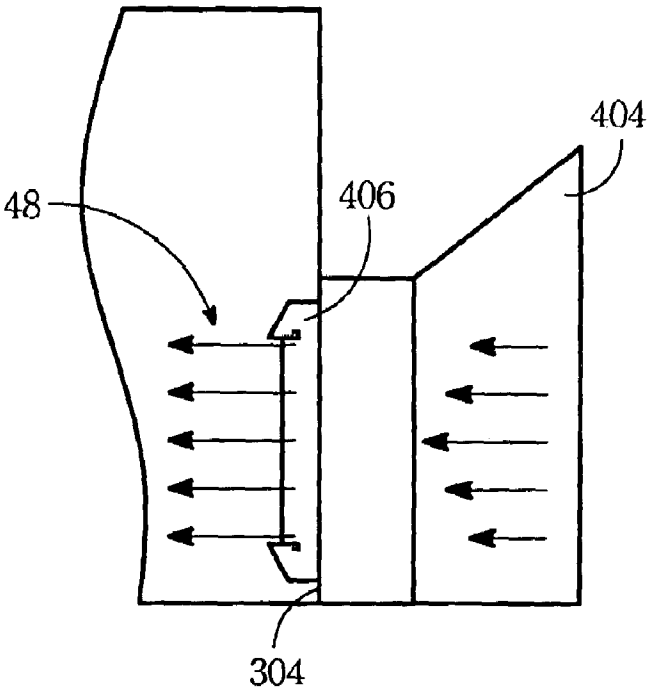

FIG. 4*c* is the side view of FIG. 4*a*.

Figure 5:
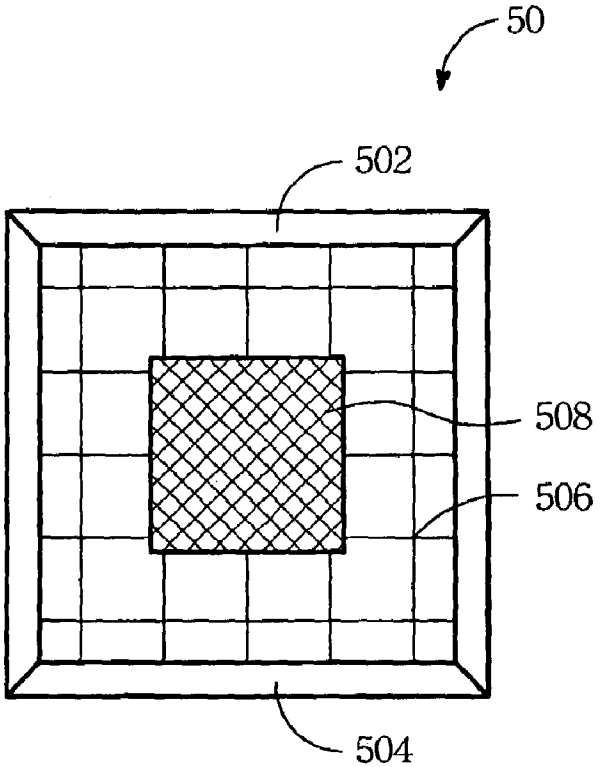

FIG. 5 is a schematic view of a preferred sieve-type velocity-profile modifying device of the present invention.

DETAILED DESCRIPTION OF THE INVENTION

The present invention is targeted to modify a conventional non-uniform velocity-profile into a preferred one of the air leaving a nozzle of a cooling system. It is well understood that most of electronic apparatuses in the market have at least a built-in heat component, such as a CPU, a hard disc, a pick-up head in a CD player, or a lighting component in a projector.

Figure 2:
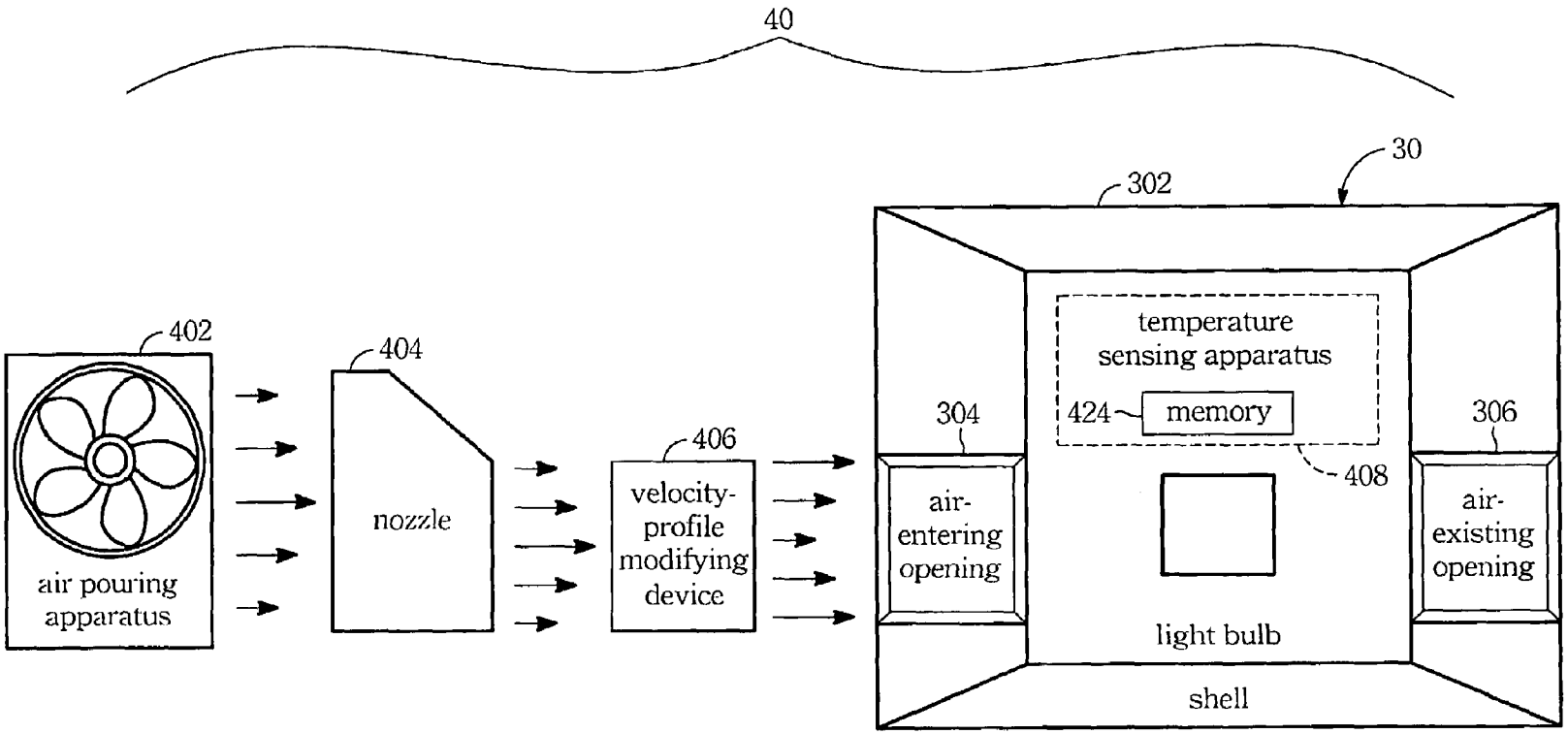
FIG. 2 is a schematic view of a light bulb and a cooling system according to the present invention.

Referring now to FIG. 2, a schematic view of a typical example of a light bulb 30 and a preferred cooling system 40 is utilized to explain details of the present invention. The light Bulb 30 of the projector is designed to have an air-entering opening 304 and an air-existing opening 306 in a shell 302 (or called a lampshade) for easy ventilation. The cooling system 40 for controlling the temperature of the light bulb 30 comprises an air pouring apparatus 402, a nozzle 404, a velocity-profile modifying device 406 and a temperature sensing apparatus 408. The nozzle 404 is constructed between the air pouring apparatus 402 and the air-entering opening 304 for directing the air into the light bulb 30. The air pouring apparatus 402, such as an electric fan or a blower, is used for pouring the air into the light bulb 30, by passing through the nozzle 404.

The velocity-profile modifying device 406 of the present invention, preferably riding on an air-moving track (not shown in the figure), can be mounted to an outlet of the nozzle 404, a connect portion between the air pouring apparatus 402 and the nozzle 404, or the air-entering opening of the light bulb 30. Wherever the velocity-profile modifying device 406 is located, the major objective of introducing the velocity-profile modifying device 406 is to modify a first velocity-profile of air pouring generated by the air pouring apparatus 402 into a preferred second velocity-profile, for example to form a concave velocity-profile 46 (faster air velocity outsides and lower air velocity insides, shown in FIG. 4*b*) or a uniform velocity-profile 48 (all the same air velocity outsides and insides is evenly distributed, shown in FIG. 4*c*), so as to make the air distribution evenly toward the light bulb 30.

Referring now to FIG. 3*a* to FIG. 3*c*, a front view, a perspective view from a left-front angle and another perspective view from a right-front angle of a preferred vane-type velocity-profile modifying device 406 according to the present invention are shown, respectively. The vane-type velocity-profile modifying device 406 is preferable to ride on and move along an air moving track who provides a moving direction approximately parallel to the flow direction of the air. That is, the construction of the vane-type velocity-profile modifying device 406 wouldn't substantially block the airflow. As shown, the vane-type velocity-profile modifying device 406 comprises an upper fastening portion 410, a lower fastening portion 412, a middle portion 414 and a folding portion 416. The upper and lower fastening portions are used for mounting securely the vane-type velocity-profile modifying device 406 onto the air moving track and thus able to prevent the vane-type velocity-profile modifying device 406 from falling off. The middle portion 414 for bridging the upper and the lower fastening portions 410, 412 is substantially parallel to a moving direction of the air such that effect upon the airflow can be reduced to a minimum. As shown, the folding portion 416 is further divided into a first folding section 418, a central folding section 420 and a second folding section 422. The central folding section 420 is folded by a first predetermined angle to align with a first direction, while the first folding section 418 and the second folding section 422 are folded by a second predetermined angle to align with a second direction. Preferably, both the first direction and the second direction are substantially vertical to the airflow direction.

As shown, two folding sections 418, 422 along the first direction and the central folding section 420 along the second direction are all bent to the same side of the middle portion 414. Preferably, the central folding section 420 is folded by a 15-degree angle with respect to the middle portion 414, and the first folding section 418 and the second folding section 422 are bent up obliquely toward the central folding portion 420 with a 90-degree angle with respect to the middle portion. Referring to FIG. 4*a* and FIG. 4*b*, a schematic front view and a schematic side view of the assembly including the velocity-profile modifying device 406, the nozzle 404, and the air-entering opening 304 are shown. As illustrated, the vane-type velocity-profile modifying device 406 is mounted in the air-entering opening 304 of the shell 302 by the upper fastening portion 410 and the lower fastening portion 412, with a state to have the first folding section 418 and the second folding section 422 direct to the interior of the light bulb 30, as shown in FIG. 4*b*. Also, the folding portion 416 including 418, 420 and 422 is designed to direct the airflow to aim at the lamp wick of the light bulb 30. As shown in FIG. 4*a*, the first folding section 418 and the second folding section 422 are seen to collect the air toward the right-center of the figure and the central folding section 420 is directed the air toward the right side of the figure. Upon such an arrangement, the central folding section 420 can be used to slow down the airflow in the central part of the air-entering opening 304. The first folding section 418 and the second folding section 422 are used to speed up the velocity of the airflow in the sides. Thereby, the velocity-profile of the air would be modified to a central-slow-and-sides-fast pattern. As shown in FIG. 4*b*, the velocity-profile of the air would be modified from the predetermined bullet velocity-profile to a special a concave velocity-profile 46. That is to say that, before the airflow flows through the velocity-profile modifying device 406 (shown by the right-hand-side arrows of FIG. 4*b*), a velocity of the outside airflow is slower than that of the center airflow. (In FIG. 4*b*, the longer arrow means the airflow flows in a higher speed, the shorter arrow means the airflow flows in lower speed) Also, after the airflow flows through the velocity-profile modifying device 406 (shown by the left-hand-side arrows of FIG. 4*b*), the velocity of the outside airflow is substantially faster than that of the center airflow. In particular, after the airflow flows through the velocity-profile modifying device 406, the velocity of the outside airflow may be equivalent to that of the center airflow. That is as shown in FIG. 4*c*, the velocity-profile of the air would be modified from the predetermined bullet velocity-profile to a special uniform velocity-profile 48. In the above description, the object of the present invention to design a velocity-profile modifying device that can direct the central air to the sides has clearly been achieved. Yet, in other embodiments, the vane can be arbitrarily folded, for example folding the side folding portion to right side and folding the central folding section to left or another type of folding.

In addition to utilize the vane as the velocity-profile modifying device, there is also other embodiment to utilize the air sieve as the velocity-profile modifying device. Referring to FIG. 5, a schematic diagram of a preferred sieve-type velocity-profile modifying device 50 of the present invention is shown. In this embodiment, the velocity-profile modifying device is designed as a sieve 50. The sieve 50 can be also set on the air moving track described above. But different with the aforesaid embodiment, the sieve 50 is substantially vertical to the flow direction of the air so as to form a drag to retard air flow. The sieve 50 comprises an upper fastening portion 502, a lower fastening portion 504, an outer portion 506 and an inner portion 508. The upper and the lower fastening portions are used for fixing the sieve-type velocity-profile modifying device 50 onto the air moving track so as to prevent the sieve-type velocity-profile modifying device 50 from falling off when the air pouring apparatus 402 is working. As shown in the FIG. 5, to lower the velocity of the central air, the sieve 50 can be designed to have an aperture ratio of the outer portion 506 bigger than that of the inner portion 508. In the present invention, the sieve is to lower the central velocity of the air, and thus can be designed into various embodiments, such as a sieve that is set only in the inner portion but outer portion is empty.

Referring back to FIG. 2, the velocity-profile of air pouring or airflow by the air pouring apparatus 402 can be modified by the above velocity-profile modifying device, and so the air could be distributed to the light bulb evenly, especially to the lamp wick (the hottest portion, not shown in FIG. 2). By applying the velocity-profile modifying device 406 of the present invention, poor cooling effect due to the bad fabrication can be avoided, and also the lift-time of the light bulb can be increased to a substantial extent.

Referring also to FIG. 2, besides the inclusion of the velocity-profile modifying device, the cooling system also comprises a temperature sensing apparatus 408. The temperature sensing apparatus 408 further comprises a plurality of sensors (not shown in FIG. 2) and a memory 424. The sensors are set at respective heat portions (such as the lamp wick and the air-existing opening) to measure on-site temperatures. The memory 424 is used for recording the temperature of each heat component and the airflow rate pouring by the air pouring apparatus in the mean time. The memory is to record the properties of each heat component for the designer to achieve a better combination of the air-entering opening, the air-existing opening and the air flow rate controlling, and also the memory can provide reference data for maintaining or for judging status of the light bulb. Also in the present invention, the airflow rate can be actively adjusted to stabilize the temperature of the light bulb.

Figure 1:
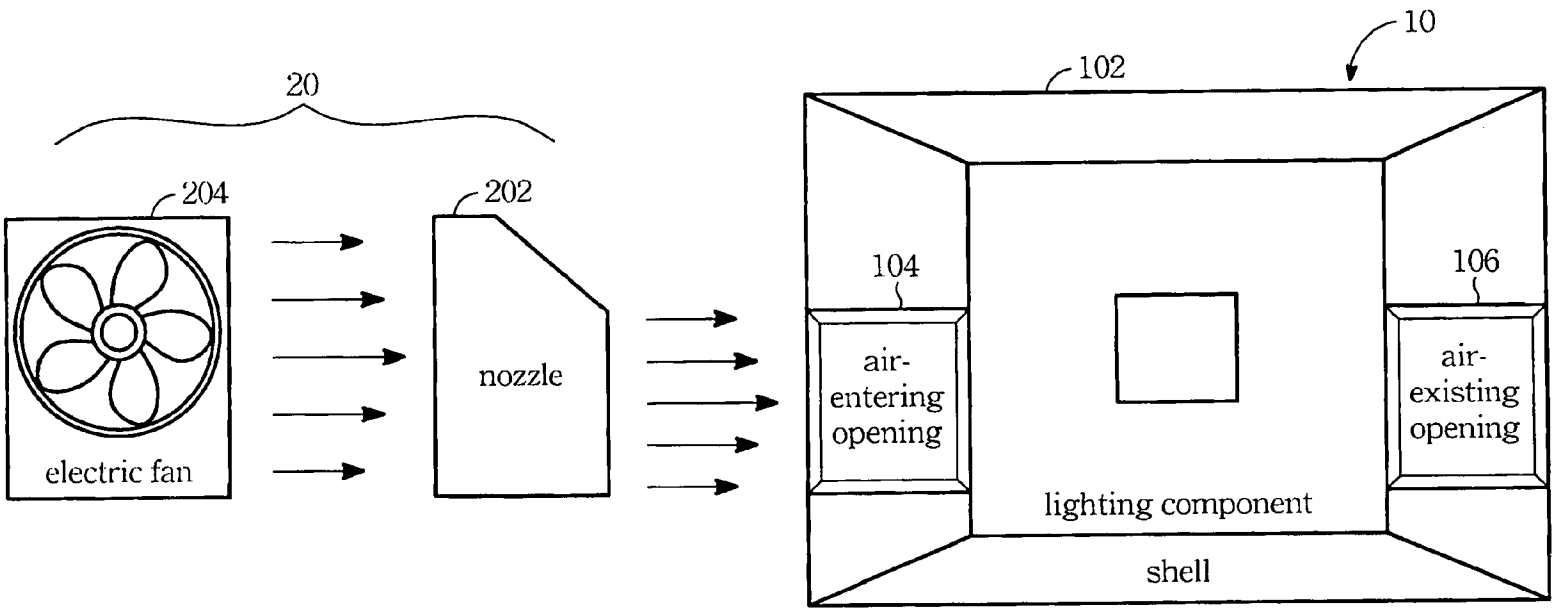
Fig.1 (Prior Art)
FIG. 1 is a schematic view of a typical lighting component and a conventional cooling system.

In summary, the present invention utilizes the low cost velocity-profile modifying device to improve shortcomings of the prior design shown in FIG. 1. Moreover, the present invention can introduce a temperature sensing apparatus to actively control the temperature of the heat component. Compared to the prior art that can only passively change the designs of the air-entering opening and the air-existing opening, the present invention can lower possible errors or bias in the manufacturing state and thus reduce the probability of early breakdown of the heat components.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A cooling system for adjusting a temperature of a heat component, the heat component comprising an air-entering opening and an air-exiting opening to let the air enter and exit, respectively, the cooling system comprising:

an air pouring apparatus for pouring the air toward the heat component;

a nozzle for connecting the air pouring apparatus with the air-entering opening to make the air pouring into the heat component; and a velocity-profile modifying device disposed between the air pouring apparatus and the heat component for modifying a first velocity-profile of airflow by the air pouring apparatus into a second velocity-profile so as to make the air distribute evenly toward the heat component, the velocity-profile modifying device further comprising a vane being set at the air moving track and being substantially parallel to the airflow, the vane comprising a middle portion and a folding portion, the middle portion being fastened on the air moving track, the folding portion being divided into a first folding section, a central folding section and a second folding section, the central folding section being folded to a first direction with a first predetermined angle, the first folding section and the second folding section being folded to a second direction with a second predetermined angle, wherein the first direction and the second direction are both substantially vertical to the airflow.

2. The cooling system of claim 1, further comprising a temperature sensing apparatus being connected to the heat component and the air pouring apparatus for actively measuring the temperature of the heat component and controlling an air flow rate pouring by the air pouring apparatus.

3. The cooling system of claim 1, wherein the second velocity-profile is a concave velocity-profile, the air of the concave velocity-profile comprising an outside airflow and a center airflow, a velocity of the outside airflow being faster than that of the center airflow.

4. The cooling system of claim 1, wherein the second velocity-profile is a uniform velocity-profile, the air of the uniform velocity-profile comprising an outside airflow and a center airflow, a velocity of the outside airflow being substantially equivalent to that of the center airflow.

5. A cooling system for adjusting a temperature of a heat component, the heat component comprising an air-entering opening and an air-exiting opening to let the air enter and exit, respectively, the cooling system comprising:

an air pouring apparatus for pouring the air toward the heat component;

a nozzle for connecting the air pouring apparatus with the air-entering opening to make the air pouring into the heat component; and a velocity-profile modifying device being set at an air-moving track for modifying a first velocity-profile of airflow by the air pouring apparatus into a second velocity-profile so as to make the air distribute evenly toward the heat component, the velocity-profile modifying device further comprising a sieve set at the air-moving track and being substantially vertical to the airflow, the sieve comprising an outer section and an inner section, an aperture ratio of the outer section being bigger than another aperture ratio of the inner section.

6. The cooling system of claim 5, further comprising a temperature sensing apparatus being connected to the heat component and the air pouring apparatus for actively measuring the temperature of the heat component and controlling an air flow rate pouring by the air pouring apparatus.

7. The cooling system of claim 5, wherein the second velocity-profile is a concave velocity-profile, the air of the concave velocity-profile comprising an outside airflow and a center airflow, a velocity of the outside airflow being faster than that of the center airflow.

8. The cooling system of claim 5, wherein the second velocity-profile is a uniform velocity-profile, the air of the uniform velocity-profile comprising an outside airflow and a center airflow, a velocity of the outside airflow being substantially equivalent to that of the center airflow.

9. A cooling system for cooling a heat component, the cooling system comprising:

an air pouring apparatus for generating an airflow with a velocity profile toward the heat component, the airflow comprising an outside airflow and a center airflow; and a velocity-profile modifying device being set at an air-moving track disposed between the air pouring apparatus and the heat component, further comprising a sieve set at the air moving-track and being substantially vertical to the airflow, the sieve comprising an outer section and an inner section, an aperture ratio of the outer section being bigger than another aperture ratio of the inner section;

wherein, after the airflow flowing through the velocity-profile modifying device, the velocity profile is modified to a central-slow-and-sides-fast pattern.

10. The cooling system of claim 9, further comprising a nozzle disposed between the air pouring apparatus and the velocity-profile modifying device, the nozzle guiding the airflow to flow toward the heat component.

11. The cooling system of claim 9, wherein, before the airflow flowing through the velocity-profile modifying device, the velocity of the outside airflow is slower than the velocity of the center airflow; wherein, after the airflow flowing through the velocity-profile modifying device, the velocity of the outside airflow is faster than the velocity of the center airflow.

12. The cooling system of claim 9, wherein, before the airflow flowing through the velocity-profile modifying device, the velocity of the outside airflow is slower than the velocity of the center airflow; wherein, after the airflow flowing through the velocity-profile modify device, the velocity of the outside airflow is substantially equivalent to the velocity of the center airflow.

* * * * *